United States Patent [19]

Morel

[11] Patent Number: 5,054,946

[45] Date of Patent: Oct. 8, 1991

[54] APPLICATOR DEVICE FOR COSMETICS

[75] Inventor: Simone Morel, Montmirail, France

[73] Assignee: Societe De Conseils Et D'Etudes Des Emballages Scee, Seine et Marne, France

[21] Appl. No.: 288,610

[22] Filed: Dec. 12, 1988

[30] Foreign Application Priority Data

Dec. 11, 1987 [FR] France ..... 87 17319

[51] Int. Cl.[5] ..... A45D 2/48; A46B 11/00

[52] U.S. Cl. ..... 401/122; 401/129

[58] Field of Search ..... 401/122, 129, 4; 132/218

[56] References Cited

U.S. PATENT DOCUMENTS 3,132,653 5/1964 Gazdik ..... 401/129 X
3,471,244 10/1969 Melocchi ..... 401/122
3,756,731 9/1973 Aubry ..... 401/122
4,332,494 6/1982 Kingsford ..... 401/129 X
4,705,053 11/1987 Goncalves ..... 401/129 X

FOREIGN PATENT DOCUMENTS 880669 10/1961 United Kingdom ..... 401/122

*Primary Examiner*—Richard J. Apley
*Assistant Examiner*—D. Crosby
*Attorney, Agent, or Firm*—Browdy and Neimark

[57] ABSTRACT

The applicator device comprises an envelope with an opened base and a top formed with a neck and a squeezing member. The envelope is closed by a foot which is part of a container which is engaged and tightly fixed inside the envelope. The neck of the envelope receives a cap forming a stem prolongated by an applicator for a cosmetics product contained in the container.

9 Claims, 1 Drawing Sheet

APPLICATOR DEVICE FOR COSMETICS

BACKGROUND OF THE INVENTION

The present invention relates to applicator devices for fluid cosmetics, and more particularly to applicator devices of fluids known under the name of mascara or eye-liner.

The above mentioned cosmetics contain solvents which are often very volatile products, so that it is important that they are contained in a perfectly tight enclosure.

Such cosmetics have to be applied on the eyelashes or eyelids by means of a brush or a pencil which has to be squeezed at the moment when it is extracted from the case containing the cosmetics, in order to prevent the cosmetics from flowing away from the brush or the pencil, and risking to stain the face or dress of a lady user, and from being applied in a too large quantity on the eyelashes or eyelids.

BRIEF DISCLOSURE OF THE PRIOR ART

The prior art has proposed various flasks or cases for cosmetics of the hereabove mentioned type.

Swiss patent specification 404,881 describes a flask with a pencil and a stirrer dipping therein in order to homogenize the cosmetics product. The flask is closed by a screwed plug for a tight compression of a seal.

Due to the volatile nature of their solvents, such an embodiment is little usable for the cosmetics concerned by the applicator device of the invention. On the other hand, the manufacture of the flask and devices contained therein is complicated.

U.S. Pat. specification No. 3,214,782 has disclosed a mascara applicator device including a case insidely provided with a restriction forming part and wings for squeezing the brush. The restriction forming part has to be maintained by a bracing tube or a ring and by a crimping of the envelope, which leads to a relatively complex realization.

Swiss patent specification 454,374 discloses a mascara applicator device including a median body formed with a restriction, a double walled container and a cap being fixed thereto.

Production of this applicator device necessitates many machining operations, and the assembly of the parts which are complex is necessarily time-consuming, so that the applicator device is costly to manufacture.

U.S. Pat. specification No. 3,896,823 discloses an applicator device in which a frustoconical container is provided at its opened portion with a flexible squeezing member. The body of the applicator is closed by a cap in which is fixed a support for a stem fitted with a brush.

There again, the number of parts constituting the applicator device is large, and their assembly necessitates a rather long working time.

OBJECTS AND SUMMARY OF THE INVENTION

The invention provides a new cosmetics applicator device made of only three parts, which can be easily produced by injection moulding, and the assembly of which can be carried out mechanically in a very simple way, thereby enabling to obtain a very cheap applicator device.

On the other hand, the container containing the cosmetics product is closed in a perfectly tight way and its content capacity can be easily adapted to the type of cosmetics to be used.

In addition, the particular realization of the applicator device of the invention is such that it can be of a reduced size, which is advantageous for lady users wishing to keep on themselves their own make-up articles, and this even when being involved in open air activities.

According to the invention, the applicator device for volatile cosmetics of the type known under the name of mascara, eye-liner, and similar, comprises an envelope with an opened base and a top formed with a neck and a squeezing member, the envelope being closed by a foot which is part of a container, which container is engaged and tightly fixed inside the envelope, the neck of the envelope receiving a cap forming a stem prolongated by an applicator for a cosmetics product contained in the container.

Various other features of the invention will become more apparent from the hereinafter detailed description.

BRIEF DESCRIPTION OF THE DRAWINGS

Embodiments of the invention are shown by way of non limiting examples in the accompanying drawings, wherein.

DETAILED DESCRIPTION OF PREFERRED EMBODIMENTS

Figure 1:
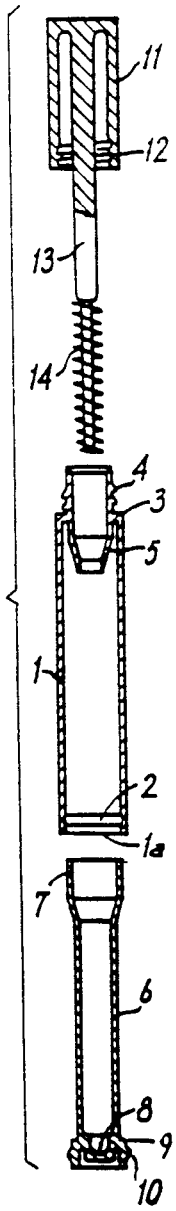
FIG. 1 is an exploded cross-sectional view in elevation of the cosmetics applicator device made according to the invention.
Figure 2:
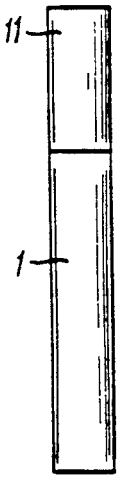
FIG. 2 is a side elevation view of the applicator device of FIG. 1 when closed.

As shown in the drawings, the applicator device comprises an envelope 1, the lower portion of which, which forms the base la, being opened and defining a groove 2.

Figure 5:
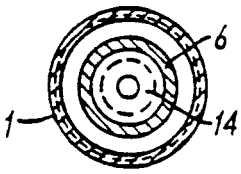
FIG. 5 is a cross sectional view taken along line V—V of FIG. 3.
Figure 6:
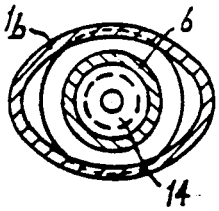
FIG. 6 is a cross sectional view similar to FIG. 5 illustrating an alternative embodiment.

The envelope 1 is indifferently of a circular cross section, as shown in FIG. 5, or of any other suitable shape, for example an ovoidal shape as shown at l*b* in FIG. 6. In its upper portion, the envelope 1 forms a shoulder 3 prolongated by a neck 4. The neck 4 is preferably threaded and of a circular cross section. However, the neck 4 may comprise a retaining element other than threads, for example resilient bars, scores, etc.

The neck 4 is prolongated toward the inside of the envelope 1 by a frustoconical squeezing member 5 which is an integral part of the envelope 1.

The envelope 1 is intended for housing a container 6 of an annular and circular section, the top of which has a flared-out part with a smooth portion 7 provided for being inserted between the frustoconical squeezing member 5, on which it is pressed, and inner portion of the envelope 1.

At its other end, the container 6 includes a solid bottom 8 surrounded by a foot 9 forming a bead 10 intended for being engaged by a resilient deformation inside the groove 2 of the envelope 1.

When the envelope 1 is of a circular cross section, the foot 9 and bead 10 are also of a circular cross section. On the contrary, when the envelope 1 has an other shape in cross section, for example an ovoidal shape as shown in FIG. 6, the foot 9 and bead 10 have then a mating shape, thereby permitting in all cases a locking of the container 6 within the envelope 1.

The applicator device comprises also a cap 11 having advantageously the same shape in cross section as the envelope 1.

The cap 11 defines, at its open part, an internal screw thread 12 or any other gripping means intended for cooperating with the threads of the neck 4 or with the retaining members possibly used instead of the threads.

The cap 11 is insidely provided with a stem 13 prolongated by a brush 14.

Figure 3:
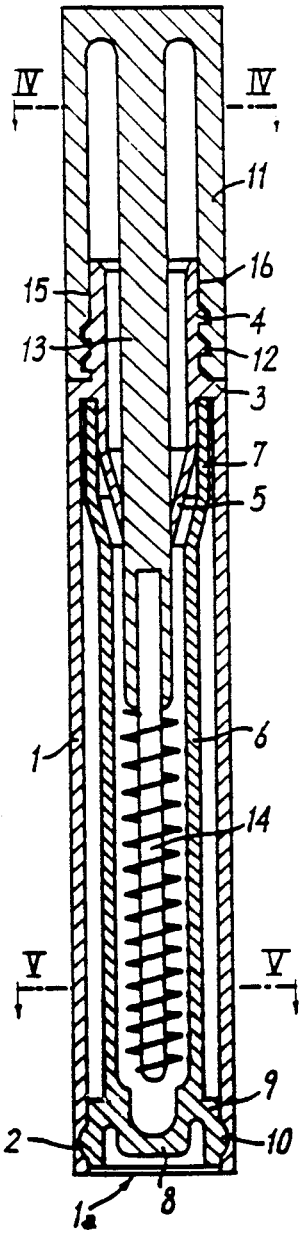
FIG. 3 is an enlarged cross sectional view in elevation illustrating the applicator device when assembled and closed and showing the mutual relation between the various parts of the application device.
Figure 4:
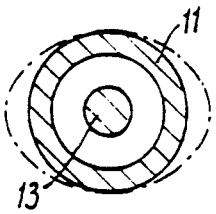
FIG. 4 is a cross-sectional view taken along line IV—IV of FIG. 3.

As shown in FIG. 3, the neck 4 of the envelope 1 has a top with a smooth portion 15 extending above the threaded neck 4, and the cap 11 has an inner wall 16 which is also smooth. Therefore, in the closed position of the cap 11, the inner wall 16 of the cap 11 will bear against the smooth portion 15 of the neck 4, thereby providing a suitable tightness between the cap 11 and the envelope 1, and by way of consequence also with the container 6, since the smooth portion 7 of the container 6 will tightly surround the upper end of the frustoconical squeezing device 5, and is therefore assembled in a tight manner with the envelope 1.

The container 6 is provided for containing a cosmetics product, particularly a product for the make-up of the eyes, and more particularly a product known under the name of mascara or also a product called eye-liner ; in the latter case, the brush 14 is replaced by a pencil.

As shown in the drawings, when it is desired to use the cosmetics product contained in the container 6, the cap 11 is removed, for example unscrewed, which permits to extract the brush 14 or the pencil.

The excess of cosmetics product entrained by the brush or pencil is retained by the end of the frustoconical squeezing member 5 formed by the envelope 1 and protruding inside the envelope 1 and, consequently, only a suitable quantity of cosmetics product is entrained by the brush or pencil.

Since the container 6 is of a circular cross section, whatever is the shape in cross section of the envelope 1, it is provided that the almost totality of the cosmetics product will be used since the container 6 is of a shape similar to that of the active portion of the brush or pencil, which would not be the case if the container 6 was for example of an ovoidal shape.

In a closed position of the applicator device, the frustoconical drying member 5 bears against the stem 13 of the cap 11 which ensures, as mentioned above, a tight closing of the portion of the container 6 containing the cosmetics product, and, consequently, the solvent of the cosmetics product does not risk evaporating.

It is advantageous, for making the envelope 1 forming the neck 4 and the frustoconical squeezing member 5, for making the container 6, and for making the cap 11, to use a plastics material, for example a polypropylene which permits a manufacture by injection making it possible to obtain parts of a great dimensional accuracy and of an attractive appearance.

The simplicity of the three parts constituting the applicator device is such that the applicator device can be made in a reduced size, for example of a total height of 8 cm for a diameter of 1 cm, which facilitates putting the applicator device inside a handbag, a pouch or similar.

What is claimed is:

1. An applicator device for containing liquid cosmetics, comprising:

an outer envelope (1) having an elongated exterior wall defining an interior space, a top end and a bottom end, said bottom end being open and having first mating means (2) for lockingly cooperating with a second element, said top end being open and having an integral downwardly extending squeezing member (5) of a frustoconical shape within the interior space of said envelope (1) and an upwardly extending exterior neck (4) for cooperative engagement with a third element, said downwardly extending squeezing member (5) and said elongated exterior wall defining therebetween a narrow annular space;

a said second element comprising an elongated container (6) within said envelope (1), said elongated container (6) having a closed bottom and an open top, said closed bottom having a size and shape for tightly fitting against an interior surface of said outer envelope and comprising second mating means (10) for mating with said first mating means (2) of said envelope (1) whereby said elongated container (6) is frictionally retained against rotation and entirely recessed and axially fixed within said envelope (1), the open top of said elongated container (6) fitting within said annular space and comprising means (7) for surroundingly gripping said squeezing member (5), said elongated container (6) having a circular cross-section of a first outer diameter and said outer envelope (1) having a cross-sectional configuration with a minimum internal dimension greater than said first outer diameter of said elongated container (6) so as to define an open annular space between said outer envelope (1) and said inner container (6) thereby permitting said outer container to have a cross-sectional configuration different from said circular cross-sectional configuration of said elongated container; and a said third element comprising a cap (11) forming a stem (13) prolongated by an applicator (14), said cap comprising third mating means (12) for cooperating with said neck (4).

2. A device as set forth in claim 1, wherein the neck (4) of the envelope (1) and the inner wall (16) of the cap (11) have mating smooth portions whereby providing tightness therebetween.

3. A device as set forth in claim 1, wherein the neck (4) is connected to the cap (11) by retaining elements.

4. A device as set forth in claim 3, wherein the retaining elements are respectively an outer and an inner screw thread.

5. A device as set forth in claim 1, wherein a foot (9) of the container (6) has a circular bead lying in a radial plane corresponding to said second mating means (10) and the envelope has a circular groove corresponding to said first mating means (2), with said bead being engaged inside said groove.

6. A device as set forth in claim 1, wherein a foot (9) of the container has a circular cross sectional shape corresponding to cross sectional shape of the envelope (1).

7. A device as set forth in claim 1, wherein the envelope (1) and the cap (11) have in cross section a same shape.

8. A device as set forth in claim 7, wherein said same shape is non-circular.

9. An applicator device according to claim 1 wherein said elongated container (6) flares upwardly and outwardly so as to terminate in said open top.

* * * * *